US009675104B2

(12) United States Patent
Dai et al.

(10) Patent No.: US 9,675,104 B2
(45) Date of Patent: Jun. 13, 2017

(54) CIGARETTE PAPER ADDITIVE HAVING HARM REDUCTION FUNCTION AND APPLICATION THEREOF

(71) Applicant: CHINA TOBACCO CHUANYU INDUSTRIAL CO., LTD, Longquanyi District, Chengu, Sichuan (CN)

(72) Inventors: Ya Dai, Chengdu (CN); Deqing Zhao, Chengdu (CN); Kefu Chen, Chengdu (CN); Kunyan Chen, Chengdu (CN); Lijun Zhu, Chengdu (CN); Yufeng Sun, Chengdu (CN); Lanlan Tan, Chengu (CN)

(73) Assignees: CHINA TOBACCO SICHUAN INDUSTRIAL CO., LTD., Chengdu (CN); CHINA TOBACCO CHONGQING INDUSTRIAL CO., LTD., Chongqing (CN)

( * ) Notice: Subject to any disclaimer, the term of this patent is extended or adjusted under 35 U.S.C. 154(b) by 216 days.

(21) Appl. No.: 14/412,523

(22) PCT Filed: Mar. 11, 2013

(86) PCT No.: PCT/CN2013/000257
§ 371 (c)(1),
(2) Date: Jan. 2, 2015

(87) PCT Pub. No.: WO2014/005418
PCT Pub. Date: Jan. 9, 2014

(65) Prior Publication Data

US 2015/0201671 A1 Jul. 23, 2015

(30) Foreign Application Priority Data

Jul. 2, 2012 (CN) ..... 2012 1 0223436

(51) Int. Cl.

| | |
|---|---|
| ***A24D 1/00*** | (2006.01) |
| ***A24D 1/02*** | (2006.01) |
| ***D21H 19/12*** | (2006.01) |
| ***D21H 23/24*** | (2006.01) |
| ***D21H 27/00*** | (2006.01) |
| ***D21H 17/14*** | (2006.01) |
| ***D21H 17/64*** | (2006.01) |
| ***D21H 17/66*** | (2006.01) |
| ***D21H 27/08*** | (2006.01) |

(52) U.S. Cl.
CPC ..... *A24D 1/02* (2013.01); *A24D 1/002* (2013.01); *D21H 17/14* (2013.01); *D21H 17/64* (2013.01); *D21H 17/66* (2013.01); *D21H 27/00* (2013.01); *D21H 27/08* (2013.01)

(58) Field of Classification Search
USPC ..... 162/139, 158; 131/365
See application file for complete search history.

(56) References Cited

U.S. PATENT DOCUMENTS

| | | | | |
|---|---|---|---|---|
| 4,611,049 | A * | 9/1986 | Kuratsuji | C08G 63/82 528/176 |
| 4,789,630 | A * | 12/1988 | Bloch | C12Q 1/28 435/28 |
| 5,100,946 | A * | 3/1992 | Hung | C08K 5/098 524/178 |
| 5,248,396 | A | 9/1993 | Casanova et al. | |
| 5,364,964 | A | 11/1994 | Casanova et al. | |
| 5,591,893 | A | 1/1997 | Kulpe et al. | |
| 6,334,448 | B1 | 1/2002 | Kuo | |
| 7,896,928 | B2 * | 3/2011 | Short | D06M 13/192 252/8.61 |
| 8,163,069 | B2 * | 4/2012 | Jiang | B01D 53/02 423/230 |
| 8,771,651 | B2 * | 7/2014 | Sharma | A61K 8/347 424/401 |

(Continued)

FOREIGN PATENT DOCUMENTS

| | | |
|---|---|---|
| CN | 1721882 | 1/2006 |
| CN | 102497986 | 6/2012 |

(Continued)

OTHER PUBLICATIONS

International Search Report of PCT/CN2013/000257 dated Jun. 20, 2013 (8 pages total).
Dai et al., "The influence of extra sylvite to tar delivery of cigarette," Tobacco Science & Technology, 1998, No. 1, pp. 11-12 (English language translation of abstract provided).
Menaa et al., Polycarboxylic acids as network modifiers for water durability improvement of inorganic-organic hybrid tin-silico-phosphate low-melting glasses, Journal of Solid State Chemistry, 2005, vol. 179, pp. 492-499.
Liu et al. "Potassium Organic Salts as Burn Additives in Cigarettes," Beitrage zur Tabakforschuang International/Contributions to Tobacco Research, 2003, vol. 20, No. 4, pp. 341-347.

(Continued)

*Primary Examiner* — Dennis Cordray
(74) *Attorney, Agent, or Firm* — Hamre, Schumann, Mueller & Larson, P.C.

(57) ABSTRACT

A cigarette paper additive having harm reduction function and application thereof are provided. The additive contains alkali metal salts of butane tetracarboxylic acid or cyclobutane tetracarboxylic acid which are prepared by reacting the butane tetracarboxylic acid or cyclobutane tetracarboxylic acid with alkali. The application thereof is evenly adding the aqueous additive solution at different concentrations to cigarette paper by a metering rod-type film transfer sizing machine in a sizing section of the cigarette paper production, and the produced cigarette paper is used for cigarette production that can effectively reduce release of CO, phenol and tar in the mainstream smoke, and has better effects of harm reduction and tar reduction. The method of the invention is easy, does not need to alter the existing cigarette paper production process, and has low cost and higher industrial application value.

3 Claims, No Drawings

(56) References Cited

U.S. PATENT DOCUMENTS

| | | | | |
|---|---|---|---|---|
| 2001/0018542 | A1 | 8/2001 | Gerle et al. | |
| 2002/0106506 | A1 | 8/2002 | Kumano et al. | |
| 2004/0035715 | A1 | 2/2004 | Putter et al. | |
| 2011/0177156 | A1* | 7/2011 | Szoka, Jr. ..... | A61K 8/63<br>424/450 |

FOREIGN PATENT DOCUMENTS

| | | |
|---|---|---|
| CN | 102733254 | 10/2012 |
| JP | 55-49336 | 4/1980 |

OTHER PUBLICATIONS

Yamamoto et al., "Effect of exogenous potassium on the reduction in tar, nicotine, and carbon monoxide deliveries in the mainstream smoke of cigarettes," Beitrage zur Tabakforschuang International, 1990, vol. 14, No. 6, pp. 379-385.

Ning et al. "Juan yan jiao you shi fang liang yu k/cl bi zhi jian de ding liang guan xi" Science & Technology, 1998, No. 5, pp. 3-4 (English language translation of abstract provided).

* cited by examiner

CIGARETTE PAPER ADDITIVE HAVING HARM REDUCTION FUNCTION AND APPLICATION THEREOF

TECHNICAL FIELD

The invention belongs to a cigarette material, specifically relates to a cigarette paper additive having harm reduction function and application thereof.

BACKGROUND TECHNOLOGY

Cigarette paper is one of effective ways for achieving harm reduction and tar reduction for cigarettes. Cigarette paper consists of three parts: plant fibers, inorganic fillers and additives, wherein the additives, especially combustion additives, can affect combustion performance of cigarettes and improve combustion quality of cigarettes through changing the combustion state of cigarette paper, thus affecting smoke components and smoke amount of cigarettes. Application of the cigarette paper additive is an important means of imparting high value added to the cigarette paper and highlighting functionalities of the cigarette paper, and research and development of the functional cigarette paper additive are important technical means of imparting high technical content to the cigarette paper, thus adapting to requirements of safety and low harm for cigarettes.

Organic alkali metal salt is a combustion additive for increasing the static combustion rate of the cigarette paper and cigarettes. (Liu C et. al., Beitrage zur Tabakforschuang International/Contributions to Tobacco Research, 2003, 20(5):341-347) sprayed potassium malate, potassium citrate and potassium tartrate onto tobacco shreds, and found that the suction temperature almost had a linear decrease when total potassium content of the potassium malate added is 3.1%-8.3%, meanwhile the draw resistance increase gradually. When total potassium content in the tobacco shreds is 5.1%, potassium salts of three organic acids can reduce nicotine by 25%-32% and reduce CO by 24%~35% in the mainstream smoke. (Yamamoto T et. al., Beitrage zur Tabakforschuang International, 1990, 14(6):379-385) investigated effects of addition of potassium salts on reduction of tar, nicotine and CO in the mainstream smoke, and found that the delivery amount of tar, nicotine and CO decreases as the amount of potassium salts added to the tobacco shreds increases. If malate is added, the puff number almost has no change, and if nitrate is added, the puff number slightly decreases. For CO reduction, the potassium malate is more effective than potassium nitrate, and for nicotine, it is the opposite. Both addition of potassium salts and increase in the amount of potassium salts can affect CO delivery amount through decreasing peak temperature of combustion areas. Addition of potassium malate less than 2% can eliminate irritability of smoke and flavour loss. (Da Ya et. al., Tobacco Science & Technology, 1998 (1):11-12 ; 1998 (5):3-4) investigated effects of some potassium salts on combustibility and tar release of cigarettes, indicating that addition of a proper amount of potassium salts can accelerate cigarette combustion.

U.S. Pat. Nos. 5,248,396, 5,364,964, 5,591,893 and US20040035715 respectively introduced several different methods for preparing butane tetracarboxylic acid. Patent No. US20010018542 disclosed a method for preparing butane tetracarboxylic acid and applications thereof in treating cellulose fibers, woven fabrics and paper products. The butane tetracarboxylic acid is cross-linked with the amorphous region of cellulose by reacting with a hydroxy group on the cellulose, this treatment manner without crimple and without ionization ensures that the fabric could keep original shape when it is washed and rubbed, and cotton, flax, rayon, paper and the like can be treated by butane tetracarboxylic acid. Application of the butane tetracarboxylic acid in combustion additive of the cigarette paper has not been reported.

Common combustion additives of the cigarette paper include citrate, malate, tartrate, succinate, acetate, etc. Now, combustion additive used by most of cigarette paper manufacturing enterprises in China is the mixed salt of potassium citrate and sodium citrate. Though use of the citrate can increase static combustion rate and reduce the puff number, however, CO delivery amount of each puff increases greatly, so excessive use of citrate can also have negative effects on sensory quality of cigarettes. With overall consideration, it is preferable to use a new cigarette paper additive which has effects of harm reduction and tar reduction, also has no significant negative effects on cigarette flavor, and meets food safety requirements, which becomes a new topic in the field of preparation technology of cigarette materials.

CONTENT OF THE INVENTION

A purpose of the invention is to provide a cigarette paper additive, which does not need to alter the existing cigarette paper production process, and has low cost and better harm reduction function, in view of the prior art.

The purpose of the invention is achieved by: a cigarette paper additive having harm reduction function which containing: alkali metal salts of butane tetracarboxylic acid or alkali metal salts of cyclobutane tetracarboxylic acid.

Said alkali metal salts of butane tetracarboxylic acid or cyclobutane tetracarboxylic acid are selected from one or more of potassium butane tetracarboxylate, sodium butane tetracarboxylate, potassium cyclobutane tetracarboxylate and sodium cyclobutane tetracarboxylate.

Another purpose of the invention is to provide application of the cigarette paper additive having harm reduction function in cigarette paper production.

The application of the cigarette paper additive of the invention having harm reduction function in cigarette paper production comprises evenly adding the aqueous solutions which contain the additive at different concentrations to cigarette paper by a metering rod-type film transfer sizing machine in a sizing section of the cigarette paper production; the amount of said potassium butane tetracarboxylate, sodium butane tetracarboxylate, potassium cyclobutane tetracarboxylate or sodium cyclobutane tetracarboxylate added to the cigarette paper is 0.3%-5% based on mass percent, more specifically the amount added is 0.6%-3.5%, and more appropriately the amount added is 1.2%.

Unless otherwise stated, all percents employed in the invention are mass percent.

The cigarette paper additive of the invention having harm reduction function contains alkali metal salts of butane tetracarboxylic acid or alkali metal salts of cyclobutane tetracarboxylic acid. Said alkali metal salts are selected from one or more of potassium butane tetracarboxylate, sodium butane tetracarboxylate, potassium cyclobutane tetracarboxylate and sodium cyclobutane tetracarboxylate.

Said potassium butane tetracarboxylate, sodium butane tetracarboxylate, potassium cyclobutane tetracarboxylate and sodium cyclobutane tetracarboxylate are prepared by reacting butane tetracarboxylic acid (cyclobutane tetracarboxylic acid) with one or more of potassium hydroxide, sodium hydroxide, potassium carbonate, sodium carbonate, potassium bicarbonate and sodium bicarbonate in aqueous solution. The reaction is carried out at the following mole ratios: mole ratio of butane tetracarboxylic acid vs potassium hydroxide (sodium hydroxide) or potassium bicarbonate (sodium bicarbonate) of 1:4, and butane tetracarboxylic acid vs potassium carbonate (sodium carbonate) of 1:2.

The percentage concentration of said aqueous solution which contains potassium butane tetracarboxylate, sodium butane tetracarboxylate, potassium cyclobutane tetracarboxylate and sodium cyclobutane tetracarboxylate is 3%-30%, more specifically the percentage concentration is 6%-15%, and more preferably the percentage concentration is 10%. pH of the aqueous additive solution is 6.5-8.2. If the pH is lower than 6.5 or higher than 8.2, the pH can be regulated to 6.5-8.2 by adding a proper amount of alkali and butane tetracarboxylic acid (cyclobutane tetracarboxylic acid) respectively.

The invention provides a preparation method of function cigarette paper containing said additive. Specific preparation method comprises: evenly adding the aqueous additive solution prepared by reaction, which has a percentage concentration of 6%-15% and contains potassium (sodium) butane tetracarboxylate or potassium (sodium) cyclobutane tetracarboxylate, to cigarette paper by a metering rod-type film transfer sizing machine in a sizing section of the cigarette paper production. Amount of said additive added to the cigarette paper is 0.3%-5% based on mass percent, more specifically the amount added is 0.6%-3.5%, and more appropriately the amount added is 1.2%.

The resulting cigarette paper is used for cigarette production, then it has better effects of harm reduction and tar reduction.

The invention first reacts butane tetracarboxylic acid (cyclobutane tetracarboxylic acid) with alkali to prepare alkali metal salts of butane tetracarboxylic acid (cyclobutane tetracarboxylic acid) and applies the additive containing potassium (sodium) butane tetracarboxylate and potassium (sodium) cyclobutane tetracarboxylate to the cigarette paper production, thus breaking a single situation of traditionally using potassium citrate and sodium citrate as the combustion additive for the cigarette paper and providing a new idea of application of a new cigarette paper additive.

Relative to the prior art, the invention has the following advantages that:

1. Application of the cigarette paper containing said additive of the invention to cigarettes can reduce CO release by 10%-18% and reduce tar release by 10%-15% in the mainstream smoke.

2. Application of the cigarette paper containing said additive of the invention to cigarettes can effectively reduce release of 7 harmful components in the mainstream smoke, wherein phenol is reduced by 10%-30%.

3. The method of the invention is easy, does not need to alter the existing cigarette paper production process, and has low cost and higher industrial application value.

SPECIFIC MODE OF IMPLEMENTATION

The invention could be understood more clearly from the following examples, but they do not limit the invention.

EXAMPLE 1

Weigh 224 parts of potassium hydroxide and add to 1500 parts of water, and stir evenly. Slowly add 234 parts of food-grade butane tetracarboxylic acid to the aqueous solution of potassium hydroxide while stirring. After reaction for half an hour, stop stirring. The concentration of the resulting potassium butane tetracarboxylate suspension is 19.7%, and measured pH of the aqueous solution is 7.97. Evenly add prepared additive suspension to the cigarette paper by a metering rod-type film transfer sizing machine in a sizing section of the cigarette paper production, and adjust the production process and parameters of the paper machine to produce cigarette paper of definite quantity of 32 g/m$^2$ and gas permeability of 60CU. Apply the produced function cigarette paper and common cigarette paper (blank sample) to production of cigarettes of a certain trademark of China Tobacco Chuanyu Industrial Corporation, and perform component analysis and sensory quality evaluation of the mainstream smoke of rolled cigarettes. Results are shown in Table 1 and Table 2, respectively.

EXAMPLE 2

Dilute the aqueous additive solution in Example 1 by 1 fold, namely the concentration of the additive is 9.85%. Repeat the production process and analysis test above. Results are shown in Table 1 and Table 2.

EXAMPLE 3

Weigh 160 parts of sodium hydroxide and add to 1200 parts of water, and stir evenly. Slowly add 234 parts of food-grade butane tetracarboxylic acid to the aqueous solution of sodium hydroxide while stirring. After reaction for half an hour, stop stirring. The concentration of the resulting sodium butane tetracarboxylate suspension is 20.2%, and measured pH of the aqueous solution is 8.12. Repeat the production process and analysis test above by using the prepared additive suspension. Results are shown in Table 1 and Table 2.

EXAMPLE 4

Dilute the aqueous additive solution in Example 3 by 1 fold, namely the concentration of the additive is 10.1%. Repeat the production process and analysis test above. Results are shown in Table 1 and Table 2.

EXAMPLE 5

Weigh 224 parts of potassium hydroxide and 160 parts of sodium hydroxide and add to 3552 parts of water, and stir evenly. Slowly add 468 parts of food-grade butane tetracarboxylic acid to the alkali solution while stirring. After reaction for half an hour, stop stirring. In the resulting additive suspension, the concentration of potassium butane tetracarboxylate is 10.9%, the concentration of sodium butane tetracarboxylate suspension is 9.1%, and measured pH of the aqueous solution is 7.88. Repeat the production process and analysis test above by using the prepared additive suspension. Results are shown in Table 1 and Table 2.

TABLE 1

Component analysis sheet of mainstream smoke of cigarettes trial-produced by functional cigarette paper additive:

| Cigarette sample | Total participate matter (mg/cigarette) | Nicotine (mg/cigarette) | Tar (mg/cigarette) | CO (mg/cigarette) | Puff number | Phenol (mg/cigarette) |
|---|---|---|---|---|---|---|
| Blank cigarette | 15.55 | 1.42 | 12.73 | 14.48 | 6.87 | 11.57 |

TABLE 1-continued

Component analysis sheet of mainstream smoke of cigarettes trial-produced by functional cigarette paper additive:

| Cigarette sample | Total participate matter (mg/cigarette) | Nicotine (mg/cigarette) | Tar (mg/cigarette) | CO (mg/cigarette) | Puff number | Phenol (mg/cigarette) |
|---|---|---|---|---|---|---|
| Ex. 1 | 12.79 | 1.07 | 10.81 | 11.77 | 6.08 | 8.07 |
| Ex. 2 | 13.14 | 1.21 | 11.22 | 12.11 | 6.21 | 8.41 |
| Ex. 3 | 13.35 | 1.23 | 11.31 | 12.65 | 6.33 | 10.11 |
| Ex. 4 | 13.64 | 1.33 | 11.05 | 12.71 | 6.12 | 10.40 |
| Ex. 5 | 12.74 | 1.09 | 10.98 | 11.98 | 5.91 | 9.83 |

TABLE 2

Smoking evaluation sheet of sensory quality of cigarettes trial-produced by functional cigarette paper additive (evaluated by 7 persons)

| Cigarette sample | Luster (5) | Fragrance (32) | Harmony (6) | Offensive odor (12) | Irritability (20) | Aftertaste (25) | Total (100) |
|---|---|---|---|---|---|---|---|
| Blank cigarette | 5 | 28 | 4.9 | 10.1 | 16.5 | 21.6 | 86.1 |
| Ex. 1 | 5 | 27.9 | 4.9 | 10.0 | 16.7 | 21.4 | 85.9 |
| Ex. 2 | 5 | 28 | 4.9 | 10.2 | 16.8 | 21.5 | 86.4 |
| Ex. 3 | 5 | 27.8 | 4.8 | 10.1 | 16.8 | 21.1 | 85.6 |
| Ex. 4 | 5 | 28 | 4.9 | 10.2 | 16.7 | 21.4 | 86.2 |
| Ex. 5 | 5 | 28 | 4.9 | 10.1 | 16.5 | 21.8 | 86.3 |

The invention claimed is:

1. A method of applying a cigarette paper additive having harm reduction function in cigarette paper production, comprising:

evenly adding an aqueous solution of the cigarette paper additive having harm reduction function to a cigarette paper by a metering rod-type film transfer sizing machine in a sizing section of the cigarette paper production, wherein the cigarette paper additive having harm reduction function contains an alkali metal salt of butane tetracarboxylic acid, an alkali metal salt of cyclobutane tetracarboxylic acid, or a combination thereof, the alkali metal salt of butane tetracarboxylic acid is one or more compounds selected from potassium butane tetracarboxylate and sodium butane tetracarboxylate, the alkali metal salt of cyclobutane tetracarboxylic acid is one or more compounds selected from potassium cyclobutane tetracarboxylate and sodium cyclobutane tetracarboxylate, and an amount of the cigarette paper additive having harm reduction function added to the cigarette paper is 0.3%-5% based on mass.

2. The method of claim 1, wherein the amount of cigarette paper additive having harm reduction function added to the cigarette paper is 0.6%-3.5% based on mass.

3. The method of claim 1, wherein the amount of cigarette paper additive having harm reduction function added to the cigarette paper is 1.2% based on mass.

* * * * *